US005754927A

United States Patent [19]

Ishiyama et al.

[11] Patent Number: 5,754,927

[45] Date of Patent: May 19, 1998

[54] MAGNETIC CHARGING BRUSH HAVING PARTICULAR MAGNETIC FIELDS

[75] Inventors: Harumi Ishiyama, Yokohama; Tadashi Furuya; Takeo Yamamoto, both of Kawasaki; Yasunori Chigono, Yokohama; Seiji Mashimo, Tokyo, all of Japan

[73] Assignee: Canon Kabushiki Kaisha, Tokyo, Japan

[21] Appl. No.: 621,885

[22] Filed: Mar. 26, 1996

[30] Foreign Application Priority Data

Mar. 27, 1995 [JP] Japan ..... 7-093137

[51] Int. Cl.[6] ..... G03G 15/02

[52] U.S. Cl. ..... 399/176

[58] Field of Search ..... 399/174, 175, 399/176

[56] References Cited

U.S. PATENT DOCUMENTS 5,381,215 1/1995 Haneda et al. ..... 355/219

5,384,626 1/1995 Kugoh et al. ..... 355/219

FOREIGN PATENT DOCUMENTS 0615177 9/1994 European Pat. Off. .

0660199 6/1995 European Pat. Off. .

0696765 2/1996 European Pat. Off. .

0709746 5/1996 European Pat. Off. .

*Primary Examiner*—Nestor R. Ramirez

*Attorney, Agent, or Firm*—Fitzpatrick, Cella, Harper & Scinto

[57] ABSTRACT

A charging device includes a charging member for charging a movable member to be charged; the charging member including a carrying member for carrying a magnetic particle layer contactable to the member to be charged, the carrying member being adapted to be supplied with a voltage; wherein a direction of a magnetic force acting on magnetic particles in the magnetic particle layer at a downstream end position with respect to a movement direction of the member to be charged at a portion where the member to be charged and the magnetic particle layer are contacted, is opposite from the member to be charged with respect to a tangent line of the member to be charged at the end position.

19 Claims, 9 Drawing Sheets

MAGNETIC CHARGING BRUSH HAVING PARTICULAR MAGNETIC FIELDS

FIELD OF THE INVENTION

The present invention relates to a charging device of contact type for charging (or discharging) a member to be charged and an image forming apparatus and process cartridge provided with the charging device.

DESCRIPTION OF THE RELATED ART

As for a charging device for charging the member to be charged such as a photosensitive member, a magnetic brush-like charging device provided with a magnetic particle layer is known as disclosed in U.S. Pat. No. 5,381,215, EP-A615177, or the like.

In the magnetic brush charging device, magnetic particles are confined on a carrying member by magnetic force to form a magnetic brush, which is contacted to the member to be charged and which is supplied with a voltage, so that the member to be charged is charged.

More particularly, the magnetic brush carrying member is in the form of a sleeve, and the magnetic particles are confined on the outer surface of the sleeve by the magnetic force of the fixed magnet roller (magnet) in the sleeve.

Referring first to FIG. 10, there is schematically shown a magnetic brush charging device of a sleeve type.

Designated by 21 is a non-magnetic electroconductive sleeve (electrode sleeve, electroconductive sleeve, charging sleeve) of aluminum such as as the magnetic brush carrying member.

Designated by 22 is a magnet roller as magnetic field generating means provided in the sleeve 21. Designated by N and S are magnetized portions of the roller. The magnet roller 22 is a non-rotatable fixed member, the sleeve 21 rotates at a predetermined peripheral speed by an unshown driving mechanism in the clockwise direction indicated by the arrow around the magnet roller 22 about an axis of the magnet roller.

Designated by 23 is an electroconductive magnetic particle, which will hereinafter be called a carrier, that is confined by the magnetic force of the magnet roller 22 in the sleeve, on the outer peripheral surface of the sleeve 21, so that the magnetic particles are supported thereon as a magnetic brush (electroconductive magnetic brush).

The carrier 23 forms magnetic erection on the outer surface of the sleeve 21 by the magnetic confining force of the magnet roller 22, so that a brush configuration is established as a whole.

Designated by S1 is a-charging bias application voltage source for applying voltage to the sleeve 21.

Designated by 1 is a member to be charged, which is a drum type electrophotographic photosensitive member rotated at a predetermined process speed in the clockwise direction indicated by the arrow, for example.

With the magnetic brush charging member 2, the magnetic brush 24 is contacted to the surface of the member to be charged 1 to form a contact nip (charging nip).

The magnetic brush 24 is moved by the rotation of the sleeve 21 in the same direction, and at the charging nip D, it charges the surface of the rotating photosensitive member 1 as the member to be charged by the charging bias applied to the magnetic brush 24 through the sleeve 21 from the voltage source S1 while rubbing the surface of the rotating photosensitive member 1, through a contact charging system. In the contact nip D, the rotation direction of the sleeve 21 and the resulting rotation transportation direction of the magnetic brush 24 is opposite from that of the rotatable photosensitive member 1 as the member to be charged.

The sleeve 21 has a carrying function for the magnetic brush, a transportation function therefor, and a charging bias application electrode function.

The above-described magnetic brush-like charging device is preferably applied to the injection charging type device which will be described.

In the injection charging type device, a DC voltage corresponding to a desired Vd is applied to a contact charging member to inject the charge to a trap unit at the surface of the member to be charged, or to charge the electric charge into an electroconductive particle of the member to be charged, having a protection layer in which electroconductive particles are dispersed.

In a method of contact charging wherein the charge is injected into a float electrode on the member to be charged (photosensitive member) having the charge injection layer on the surface, a charge injection layer may be on the surface of the photosensitive member and may be of antimony doped (electroconductive filler) acrylic resin material in which electroconductive $SnO_2$ particles are dispersed.

In such an injection charging type, the charging member and the member to be charged are directly contacted to effect transfer of the electric charge, and therefore, they are closely contacted, so that no microscopic non-charged portions occur. The magnetic brush-like charging device is suitable in the injection charging type, since it can closely contact the member to be charged, and a peripheral speed difference can be provided relative to the member to be charged.

However, the magnetic brush-like charging device involves the following problems. Release of the carrier 23 from the magnetic brush 24 and deposition of the released carrier 23 on the member to be charged 1.

When the carrier 23 constituting the magnetic brush 24 is released from the magnetic confining force and is carried over to the surface of the member to be charged 1, the amount of the carrier particles of the magnetic brush 24 contributable to the charging is reduced, with the result of charging defect.

There is a problem arising from the deposition of the released carrier on the surface of the member to be charged. For example, in the case of the image forming apparatus:

1. Obstruction to the image exposure by the carrier deposited on the photosensitive member as the member to be charged;
2. Current image defect at the position of carrier deposition on the photosensitive member;
3. Deterioration of the developing performance due to the carrier introduced into the developing device;
4. Fixing defect due to the carrier being not fixed if the carrier is transferred onto the transfer material;
5. Damage to the photosensitive member due to the carrier not transferred to the transfer material existing between a cleaning blade and the photosensitive member at a cleaning position.

SUMMARY OF THE INVENTION

Accordingly, it is a principal object of the present invention to provide charging device, a process cartridge and an image forming apparatus, wherein the release of the magnetic particles from the charging device and the deposition of the magnetic particles on the member to be charged are prevented.

It is another object of the present invention to provide a charging device, process cartridge and image forming apparatus wherein the charging defect due to the release of the magnetic particles from the charging device is prevented.

According to an aspect of the present invention there is provided a charging device, comprising a charging member for charging a movable member to be charged; said charging member including a carrying member for carrying a magnetic particle layer contactable to the member to be charged, and said carrying member being adapted be supplied with a voltage; wherein a direction of a magnetic force acting on magnetic particles in the magnetic particle layer at a downstream end position with respect to a movement direction of the member to be charged at a portion where the member to be charged and the magnetic particle layer are contacted, is opposite from the member to be charged with respect to a tangent line of the member to be charged at the end position.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

1. An example of image forming apparatus (FIG. 1)

Figure 1:
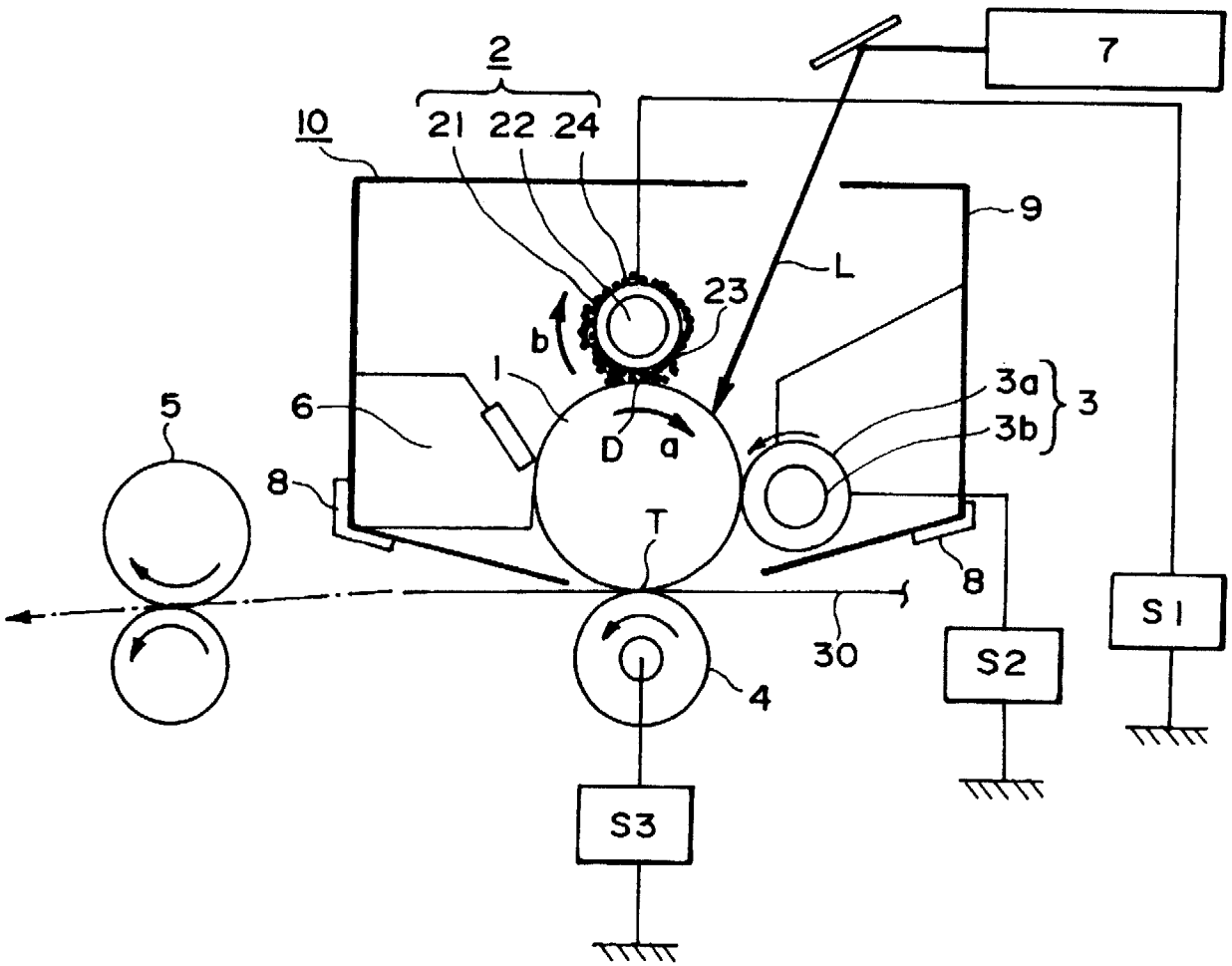
FIG. 1 is a schematic structure of an example of an image forming apparatus.

FIG. 1 shows an example of an image forming apparatus.

The image forming apparatus of this example is a process cartridge mounting-and-demounting type laser beam printer using a transfer type electrophotographic process.

An image bearing member is an OPC photosensitive member having a charge injection function at the surface, and a contact charging member is a magnetic brush charging member, wherein the image bearing member is subjected to a primary charging through injection type charging.

The image bearing member is an electrophotographic photosensitive member of a rotation drum type. In this embodiment, it is an OPC photosensitive member having a charge injection function and has a diameter of 30 mm. It is rotated at a process speed (peripheral speed) of 100 mm/sec in the clockwise direction indicated by the arrow. The layer structure of the photosensitive member will be described hereinafter.

Figure 10:
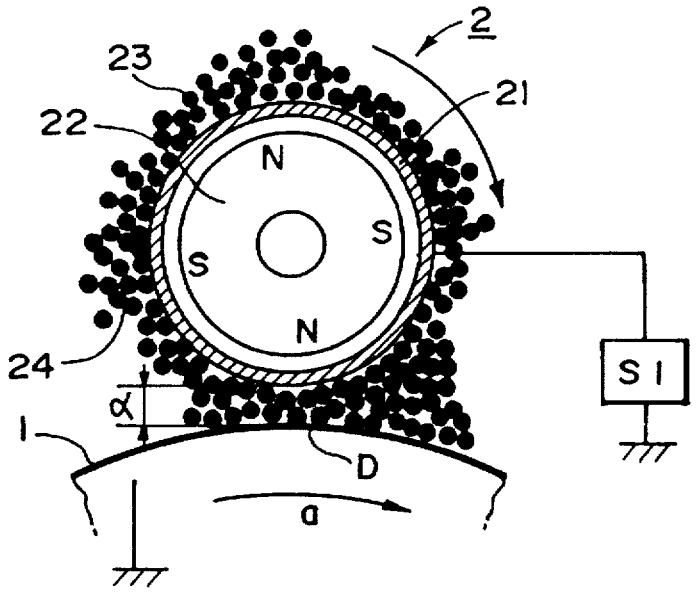
FIG. 10 PRIOR ART
FIG. 10 is a schematic structure schematic view of the magnetic brush charging device of a sleeve type.

Designated by 2 is a contact charging member for uniformly charging the peripheral surface of the photosensitive member 1 to a predetermined polarity and potential, and more particularly is a sleeve type magnetic brush charging member as shown in FIG. 10, in this embodiment. The magnetic brush charging member 2 will be described hereinafter in detail.

The sleeve 21 of the magnetic brush charging member 2 is supplied with a DC charging bias of −700 V from the charging bias application voltage source S1, and the outer peripheral surface of the rotatable photosensitive member 1 is uniformly charged to approximately −700 V through the charge injection charging.

The thus charged surface of the rotating photosensitive member 1 is exposed to and scanned by a laser beam having an intensity modulated in accordance with time series electric digital pixel signal corresponding to the intended image information, so that an electrostatic latent image thereof is formed. The laser beam is projected from an unshown laser beam scanner including a laser diode, polygonal mirror or the like.

The electrostatic latent image is developed into a toner image by a reverse development device 3 using magnetic one component insulative toner (negative charged toner). Designated by **3*a* is a non-magnetic developing sleeve having a diameter of 16 mm and containing therein a magnet 3*b*. The developing sleeve 3*a* is coated with the negatively charged toner. The gap between the developing sleeve 3*a* and the surface of the photosensitive member 1 is fixed at 300 μm. It is rotated at the same peripheral speed as the photosensitive member 1 while the developing sleeve 3*a* is supplied with a developing bias voltage from the developing bias voltage source S2. The voltage is in the form of a superposed DC voltage of −500 V and a rectangular AC voltage having a frequency of 1800 Hz and a peak-to-peak voltage of 1600 V, so that a so-called jumping development is effected. The toner charged to the negative polarity fed from the developing sleeve 3*a*** is deposited by the electric field to the image portion of the latent image, thus effecting development.

On the other hand, a transfer material 30 as the recording material is supplied from an unshown sheet feeding portion, and is fed at a predetermined timing into a nip (transfer portion) T formed between the rotatable photosensitive member 1 and an intermediate resistance transfer roller 4 (contact transferring means) press-contacted thereto with a predetermined urging force. The transfer roller 4 is supplied with a predetermined transfer bias voltage from a transfer bias application voltage source S3. In this embodiment, the transfer roller 4 includes a core metal and an intermediate resistance foamed layer having a resistance value of $5\times10^8\Omega$. The core metal is supplied with +2000 V of DC voltage to charge the back side of the transfer material.

The transfer material 30 introduced into the transfer portion T is fed through the transfer portion T to receive the toner image from the surface of the rotatable photosensitive member 1 by the electrostatic force and the pressure.

The transfer material 30 having received the transferred image, is separated from the surface of the photosensitive member 1 and is introduced into a fixing device 5 such as a heat fixing type, where the toner images are fixed on the transfer material 30, which is then discharged to the outside of the device as a print or copy.

The surface of the photosensitive member after transfer of the toner image is cleaned by a cleaning device 6 so that the deposited contamination such as the residual toner is removed, so as to be prepared for the next image formation.

In the image forming apparatus of this example, four process means, namely the photosensitive member 1, magnetic brush charging member 2, developing device 3, and cleaning device 6, are contained in a process cartridge 10 detachably mountable relative to the main assembly of the image forming apparatus. Designated by 9 is a cartridge housing containing the four process means 1, 2, 3, 6 at predetermined positions. Designated by 8 are guides and supports in the main assembly side of the image forming apparatus, provided for the process cartridge mounting and demounting.

When the process cartridge 10 is placed at the predetermined position of the main assembly of the image forming apparatus, the process cartridge 10 side and main assembly side are connected mechanically and electrically, and the lower surface of the photosensitive member 1 in the process cartridge 10 is contacted in a predetermined manner to the transfer roller 4 of the main assembly, so that the image formation executable state is established.

Here, the process cartridge is a cartridge which is detachably mountable to a main assembly of an image forming apparatus and which contains as a unit an electrophotographic photosensitive member and at least one one of process means such as charging means, developing means, cleaning means or the like. The process cartridge is a cartridge which is detachably mountable to a main assembly of an image forming apparatus and which contains as a unit an electrophotographic photosensitive member and a process means such as charging means, developing means, cleaning means or the like. The process cartridge is a cartridge which is detachably mountable to a main assembly of an image forming apparatus and which contains as a unit an electrophotographic photosensitive member and developing means.

2. Photosensitive member 1 and injection charging a) Photosensitive member 1 (FIG. 2)

Figure 2:
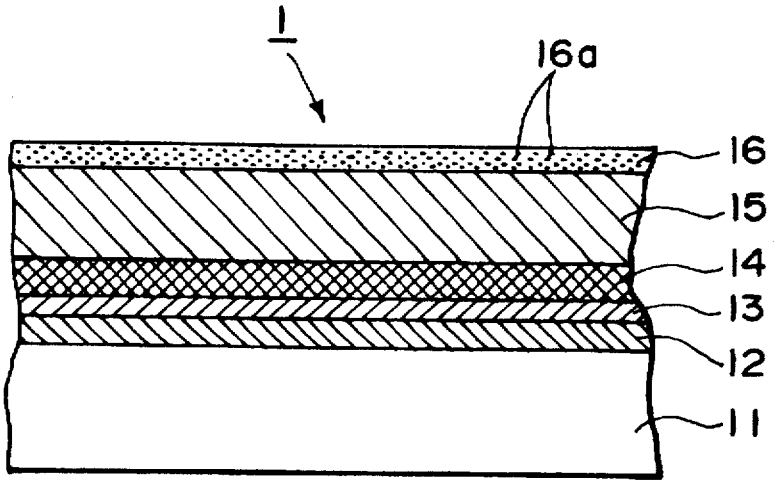
FIG. 2 is a layer structure schematic view of a photosensitive member.

FIG. 2 is a layer structure schematic view of the photosensitive member 1 as the member to be charged used in this embodiment. The surface of the photosensitive member 1 of this embodiment is of an OPC photosensitive member chargeable to the negative polarity and having the charge injection function, and it comprises a drum base 11 of aluminum having a diameter of 30 mm and first through fifth layers (function layers 12–16) in this order from the bottom.

The first layer is a primer layer 12, and it functions to make uniform the outer peripheral surface of the aluminum drum base 11 and to prevent the occurrence of moire due to reflection of the laser exposure.

The second layer is a positive charge injection preventing layer 13 and functions to prevent the positive charge charged from the aluminum base 11 from canceling the negative charge charged to the surface of the photosensitive member. It is an intermediate resistance layer of AMILAN (tradename of polyamide resin material, available from Toray Kabushiki Kaisha, Japan) resin material and methoxymethyl nylon having adjusted resistance of approximately $10^6$ Ωcm and having a thickness of approximately 1 μm.

The third layer is a charge generating layer 14 of disazo type pigment dispersed in resin material and having a layer thickness of 3 μm, which generates pairs of positive and negative charge upon laser exposure.

The fourth layer is a charge transfer layer 15 of hydrazone dispersed in polycarbonate resin material, and is a P type semiconductor. Therefore, the negative charge on the surface of the photosensitive member cannot move through this layer, but only the positive charge generated in the charge generating layer 13 is permitted to transfer to the photosensitive member surface.

The fifth layer is a charge injection layer 16 of $SnO_2$ as electroconductive particle (electroconductive filler) in the form of ultra-fine particles dispersed in light curing acrylic resin material (coating layer). More particularly, 70% by weight, on the basis of the resin material, of the $SnO_2$ particles having the particle size of approximately 0.03 μm and treated for low resistance by antimony doping, is dispersed in the resin material. Such coating liquid is applied into a thickness of approximately 2 μm by dip coating method, thus forming the charge injection layer.

By doing so, the resistance of the surface of the photosensitive member 1 was decreased to $1\times10^{13}$ Ωcm, while that of the charge transfer layer alone was $1\times10^{15}$ Ωcm.

In the charge injection layer 16, injection cite is intentionally produced to accomplish uniform charging upon direct injection of the charge from the magnetic brush charging member 2, but in order to prevent surface flow of the charge of the latent image, the resistance of the charge injection layer 16 is preferably $1\times10^8$ Ωcm or higher. The resistance value of the charge injection layer 16 was measured in the following manner. The charge injection layer is applied on aluminum, and the volume resistivity is measured under the applied voltage of 100 V, using a high resistance meter 4329A, available from YHP(YOKOKAWA HEWLETT PACKARD, JAPAN). The volume resistivity of the injection layer is preferably $1\times10^{10}$–$1\times10^{14}$ Ωcm.

In this embodiment, the charge injection layer 16 is provided as an independent layer. However, what is important is that the photosensitive member surface layer has an electronic level permitting electron application, and therefore, the independent structure is not inevitable.

Figure 3B:
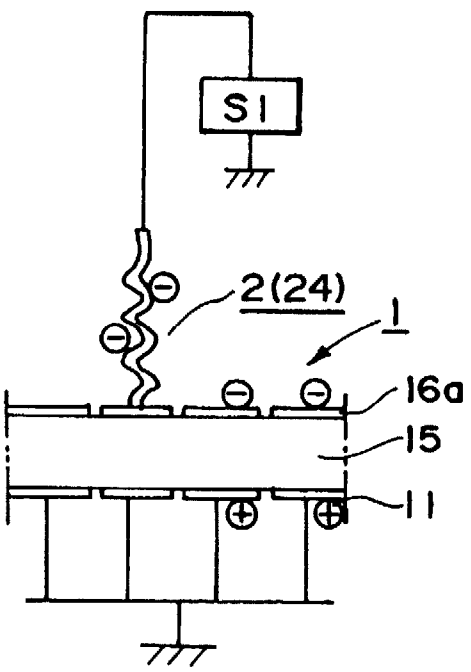
FIG. 3 is an illustration of the principle of the injection charging.
Figure 3A:
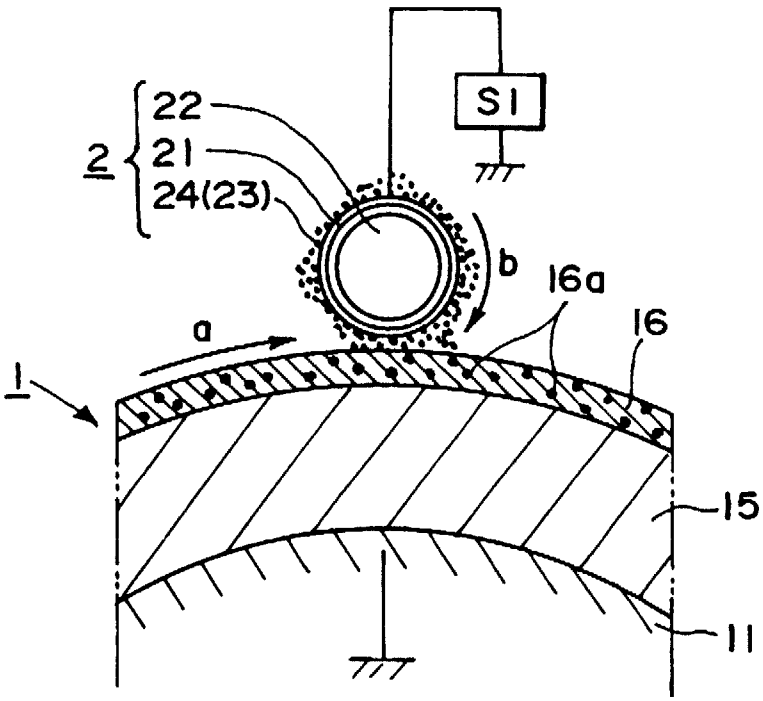

From the standpoint of reducing deposition of the carrier on the magnetic brush charging member side relative to the surface of the photosensitive member, it is preferable that the photosensitive member 1 has a low surface energy property, and the outermost surface of the photosensitive member preferably has a predetermined sliding property by adding desired sliding property imparting material.

b) Injection charging (FIG. 3)

In the charge injection charging for the photosensitive member of this embodiment, the charge injection is effected to the intermediate resistance photosensitive member surface by the intermediate resistance contact charging member. It is not the charge injection to the trap potential of the material of the surface of the photosensitive member, but it is the charging by supplying the charge to the electroconductive particle **16*a* of the charge injection layer 16. By applying a voltage to the magnetic brush charging member 2 during the charging operation, the charge is injected into the charge injection layer 16 so that the surface of the photosensitive member 1 as the member to be charged is charged to the same potential as the magnetic brush 24** finally.

More particularly, as shown in the equivalent circuit diagram of FIG. 3, (a) and (b), the photosensitive member 1 can be deemed as an aggregate of series of small capacitors constituted by the charge transfer layer 15 as a dielectric member and the electroconductive particles **16*a* ($SnO_2$) in the charge injection layer 16 and the aluminum drum base 11 as electrode plates. The injection charging is based on theory in which the charge is charged by the contact charging member 2** into the fine capacitors, respectively.

The electroconductive particles 16*a* are electrically independent, and therefore, constitute fine float electrodes. Therefore, macroscopically, the surface of the photosensitive member 1 seems to be charged to uniform potential, but actually, a great number of the charged electroconductive particles 16*a* covers the surface of the photosensitive member. So, even if the image exposure L is effected by the laser beam, the electrostatic latent image can be retained, since the respective electroconductive particles 16*a* are electrically independent.

3. Magnetic Brush Charging Member 2 (FIG. 4)

Figure 4:
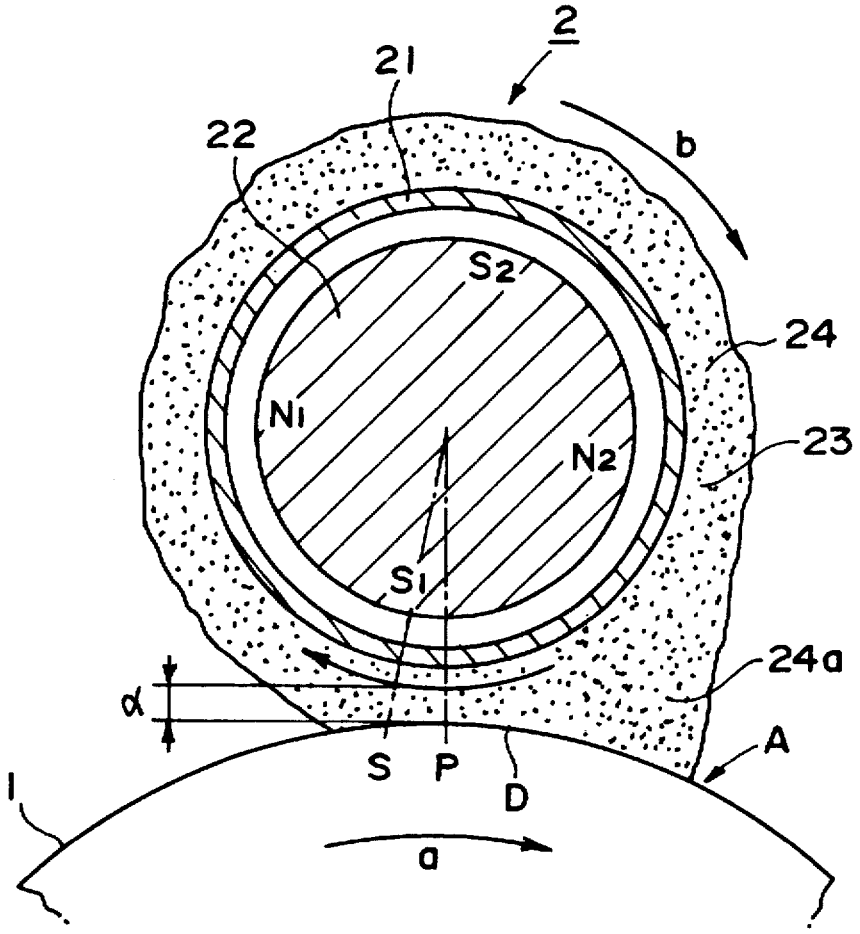
FIG. 4 is a structure schematic view of a magnetic brush charging member as a contact charging member used in an embodiment of the present invention.

FIG. 4 is a structure schematic view of the magnetic brush charging member 2 as the contact charging member used in this embodiment, and it is of a sleeve type as in FIG. 10 as described hereinbefore.

The carrying member for supporting the carrier 23 for constituting the magnetic brush 24 is a rotatable non-magnetic electroconductive sleeve 21 (sleeve or charging sleeve), and the magnetic field generating means in the sleeve 21 is a fixed magnet roller 22 which functions to confine the carrier 23 to the outer surface of the sleeve 21 by the magnetic force to form a magnetic brush 24.

In this embodiment, the outer diameter of the sleeve 21 is 16 mm. The carrier amount of the magnetic brush 24 is approximately 10 g, and the gap between the charging sleeve 21 and the photosensitive member 1 at the contact nip (charging nip) D between the magnetic brush 24 and the photosensitive member 1 is 500 μm. The width of the magnetic brush in the longitudinal direction is 230 mm.

The carrier 23 on the sleeve 21 has a layer thickness of 1 mm and forms a magnetic brush 24 which in turn forms the contact nip D having a width of approximately 5 mm with the photosensitive member 1. The sleeve 21 is rotated in the opposite direction relative to the surface of the rotatable photosensitive member 1 (the photosensitive member surface movement direction and the sleeve surface movement direction are opposite from each other at the nip SD). By the rotation of the sleeve 21, the magnetic brush 24 revolves in the same direction as the sleeve 21 so that the carrier 23 constituting the magnetic brush is moved, and therefore, the carrier sequentially passes through the contact nip D while being contacted to the surface of the photosensitive member 1.

A stagnation portion 24*a* of the carrier is formed at the downstream end portion of the contact nip D of the magnetic brush 24 in the photosensitive member rotation direction.

a) Peripheral speed ratio between the magnetic brush 24 and the photosensitive member 1

The peripheral speed ratio between the magnetic brush 24 and the photosensitive member 1 is defined by the following:

The peripheral speed ratio %=((magnetic brush peripheral speed−photosensitive member peripheral speed)/photosensitive member peripheral speeds)×100, where the peripheral speed of the magnetic brush is negative in the case of counter directional rotation.

Peripheral speed ratio=100% means no movement of the magnetic brush 24, and therefore, the configuration the magnetic brush 24 at a fixed position of the surface of the photosensitive member tends to remain as a charging defect. The codirectional rotation means relatively low speed movement of the magnetic brush 24 relative to the photosensitive member 1, and the carrier 23 of the magnetic brush 24 tends to be deposited on the photosensitive member 1. If an attempt is made to provide the same peripheral speed ratio as in the counterdirectional rotation, the rotational speed of the magnetic brush 24 becomes very high. Therefore, the peripheral speed ratio is preferably not more than −100%, and it was −150% in this embodiment.

b) Carrier 23

The carrier 23 as the magnetic particles constituting the magnetic brush 24 is produced by kneading the resin material and magnetic powder such as magnetite and forming it into particles, or by further mixing electroconductive carbon thereto for resistance value control.

Or, it may be produced by sintered magnetite or ferrite or those deoxidized or oxidized for resistance value adjustment.

Alternatively, it may be produced by coating the carrier with a coating material having an adjusted resistance (carbon dispersed phenolic resin or the like) or by plating process of them with metal such as Ni for the resistance value adjustment.

In order to reduce the damage of the photosensitive member 1, the carriers 23 are desirably subjected to treatment for the spherical shape.

If the resistance value of the carrier 23 is too high, the charge cannot be uniformly injected into the photosensitive member 1 with the result of a fine charging defect and therefore a fog image. If it is too low, and if the photosensitive member surface has a pin hole, the current is concentrated to the pin hole with the result of charged potential drop and therefore incapability of charging the photosensitive member surface, thus resulting in a charging defect in the form of the charging nip-like. From the foregoing, the resistance value of the carrier 23 is desirably $1\times10^4$–$1\times10^7$ Ω. The resistance value of the carrier 23 is determined as follows; 2 g of carrier is placed in a metal cell having a bottom area of 228 $mm^2$ and capable of being supplied with a voltage, and thereafter, is pressed with 6.6 $kg/cm^2$. The voltage of 1–1000 V, for example, 100 V is applied between the top and the bottom. From the measured current, the resistance value is calculated and normalized.

It is possible to improve the charging property by using mixed different carriers.

As for the particle size of the carrier 23, if it is too fine, the magnetic confining force is small with the result of a tendency of carrier deposition on the surface of the photosensitive member 1. If it is too large, the contact area relative to the photosensitive member 1 is reduced with the higher possibility of charging defect. Therefore, the average particle size of the carrier particles is desirably approximately 5–500 μm from the standpoint of the charging property and the magnetic retention property.

As for the magnetic property of the carrier, the magnetic confining force is preferably high in order to prevent the carrier deposition on the photosensitive member, and therefore, the saturation magnetization is preferably not less than 30 $A.m^2/kg$ and further preferably not less than 50 $A.m^2/kg$.

The saturation magnetization is measured using a vibration magnetic field type magnetic property automatic recording device BHV-30 available from Riken Denshi KABUSHIKI Kaisha, Japan. The magnetic property value of the carrier powder is determined as follows: an external magnetic field of ±1K oersted is produced, and the intensity of the magnetization at the magnetic field of 1K oersted is determined from a hysteresis curve at that time.

The carrier 23 used in this embodiment had an average particle size of 30 μm, a resistance value of $1\times10^6$ Ωand a saturation magnetization of 58 $A.m^2/kg$, and the shapes of the particles were spherical.

c) magnetic force

Figure 5:
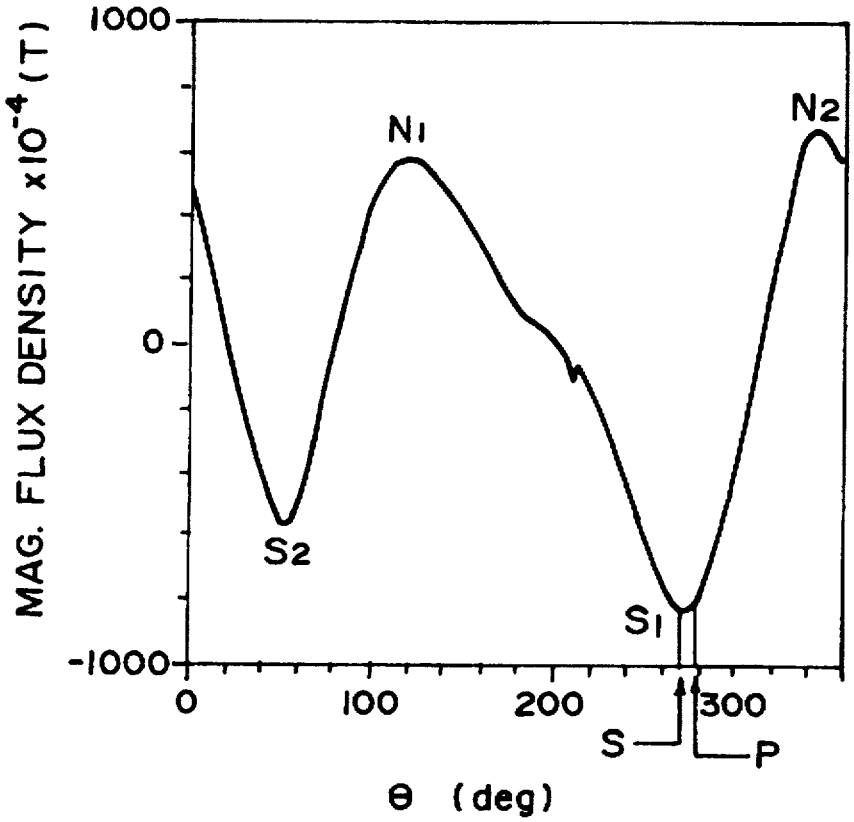
FIG. 5 is a graph of a distribution of a magnetic flux density of a magnet roller.

The fixed magnet roller 22 as magnetic field generating means used in this embodiment is a 4 pole magnetization roller having $S_1$, $N_1$, $S_2$, $N_2$ poles, and the magnetic flux density distribution at the surface of the charging sleeve 21 in the normal line direction provided by the magnet roller 22 is shown in FIG. 5. The negative side of the ordinate represents the S-pole, and the positive side represents the N-pole, and the angle in the N-pole decreases in the direction of the charging sleeve rotation.

In order to prevent the deposition of the carrier 23 of the magnetic brush 24 on the photosensitive member 1, the main magnetic pole $S_1$ of the fixed magnet roller 22 is preferably adjacent the closest position between the charging sleeve 21 and the photosensitive member 1 (P point on FIG. 4). In this embodiment, the main magnetic pole $S_1$ is disposed at a position (S point on FIG. 4) which is about 6° (−6°) away from the closest position P toward downstream in the direction of the charging sleeve rotation, so as to prevent deterioration of the charging property due to stagnation, in the gap of the contact nip D, of the carrier 23 of the magnetic brush 24 by the magnetic flux density of the main magnetic pole $S_1$. By this arrangement, the force for pulling the carrier of the magnetic brush 24 out of the closest position P is produced, thus making smooth the motion (conveying) of the magnetic brush carrier in the gap of the contact nip D.

The magnetic flux density in the normal line direction at the main magnetic pole $S_1$ (S point on FIG. 4) is approximately $840\times10^{-4}$T (tesla), as indicated at a position of 270° n the abscissa of the graph of FIG. 5. The magnetic force F acting on the carrier in the magnetic flux density is as follows:

$$F=(\mu-\mu o)/\{\mu o(\mu+2\ \mu o)\}2\pi b^3\ \text{gradiant}B^2$$

where

μo is magnetic permeability of vacuum;

μis magnetic permeability of magnetic particle (carrier);

b is radius of magnetic particle; and

B is magnetic flux density.

The magnetic force can be calculated using the mathematical expression, and the magnetic force F is proportional to the square of the magnetic flux density B.

Whether the carrier 23 of the magnetic brush 24 is deposited or not on the surface of the photosensitive member 1 as the member to be charged, is determined at the downstream end position A, in the photosensitive member rotation direction, in the contact nip D formed between the photosensitive member 1 and the magnetic brush 24. A resultant force vector F of the magnetic force component Fr in the normal line direction and that FΘ in the tangent line direction is the magnetic force acting on the magnetic brush carrier at the position A. The force Fr is a component in the normal line direction of the magnet roller 22, and the force FΘ is the component in the tangent line direction of the magnet roller 22.

Figure 6:
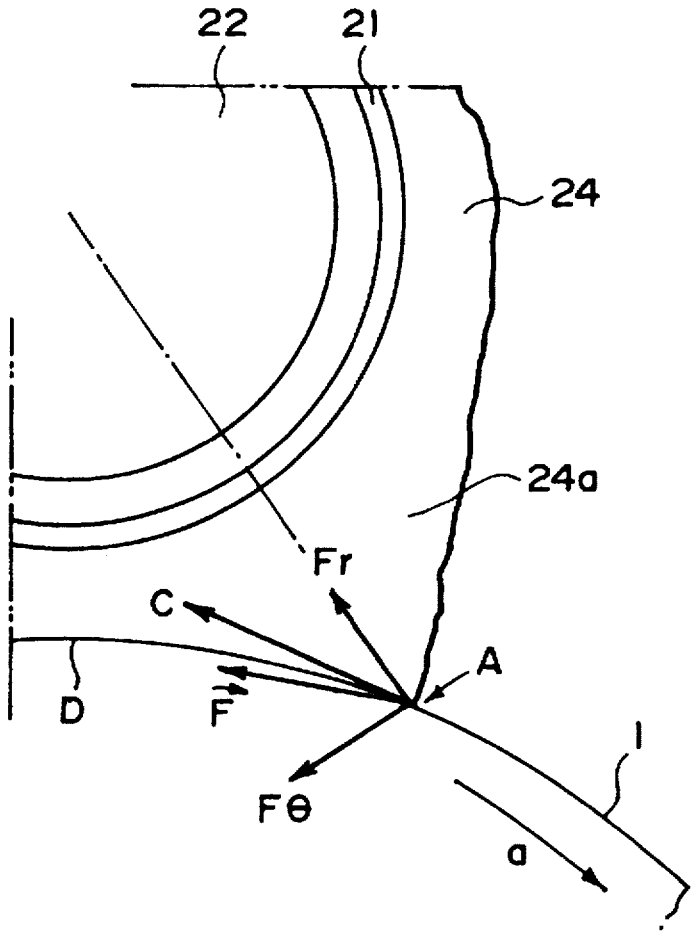
FIG. 6 is an illustration (1) of magnetic force applied to the magnetic brush carrier at a downstream end position in the photosensitive member rotation direction at the contact nip of the magnetic brush with the photosensitive member.

If the resultant force vector F is directed toward the inside of the photosensitive member more than the photosensitive member tangent line direction C, as shown in FIG. 6, the magnetic force urges the magnetic brush carrier to the photosensitive member surface at the position A.

Figure 7:
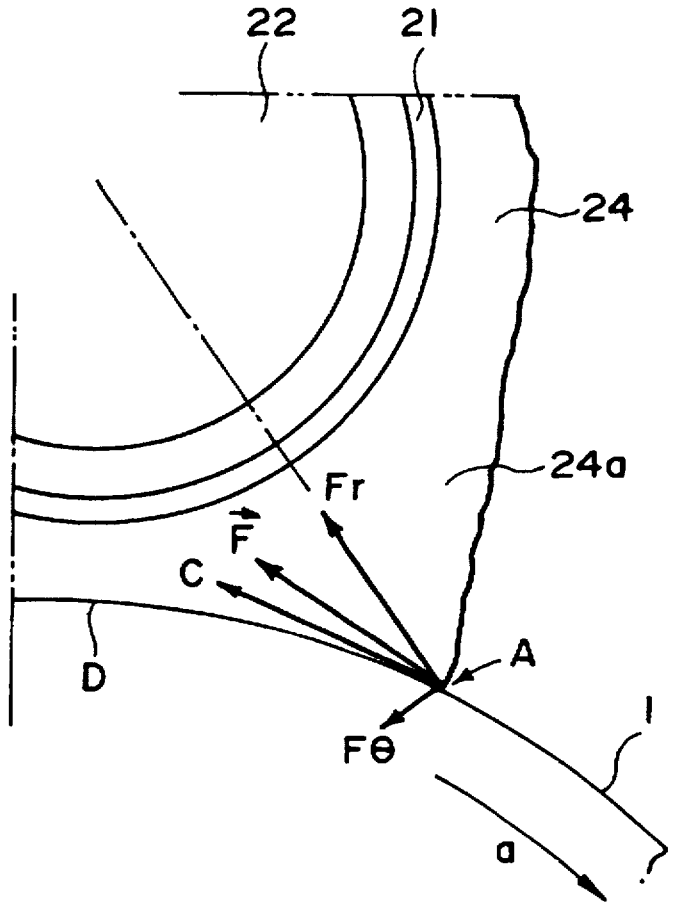
FIG. 7 is an illustration (2) of magnetic force applied to magnetic brush carrier at a downstream end position in the photosensitive member rotation direction at the contact nip of the magnetic brush with the photosensitive member.

According to this embodiment, however, as shown in FIG. 7, the magnetic flux density distribution of the fixed magnet roller 22 is selected so that the resultant force F of the magnetic force is directed away from the side, with respect to the tangent line C of the photosensitive member at the position A, where the photosensitive member is provided. By this, the force urging the magnetic brush carrier to the photosensitive member 1 at the position A is eliminated, so that the deposition of the magnetic brush carrier 23 onto the photosensitive member 1 is significantly reduced. Therefore, the image defect attributable to the deposition of the magnetic brush carrier 23 to the photosensitive member 1 can be avoided.

Figure 8:
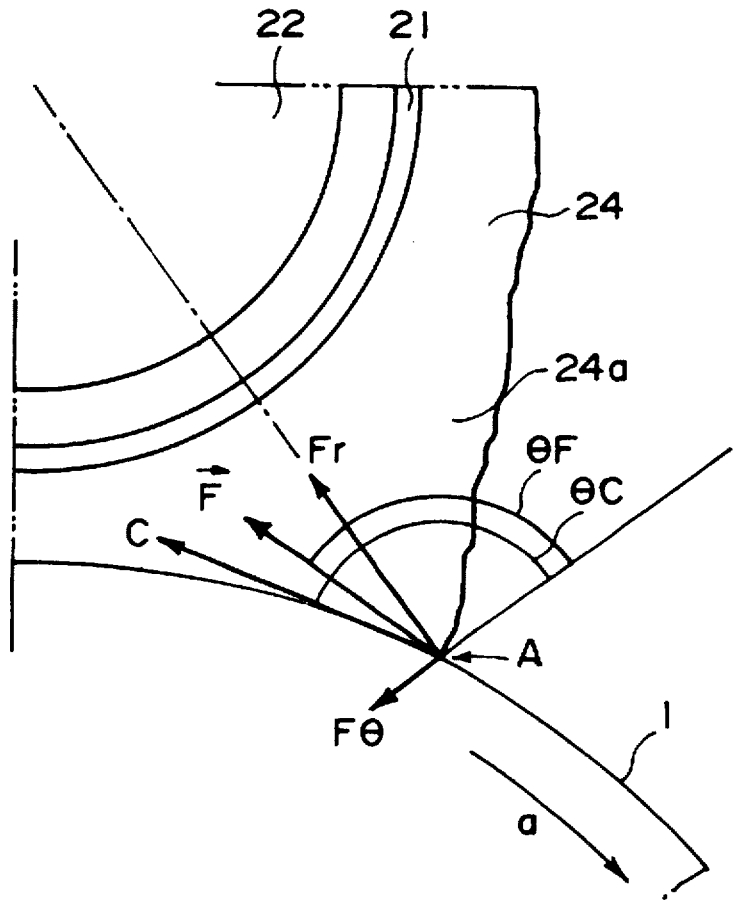
FIG. 8 is an illustration of magnetic force applied to a magnetic brush carrier at a downstream end position in the photosensitive member rotation direction at the contact nip of the magnetic brush with the photosensitive member.

Referring to FIG. 8, the relation will be described. When the direction of FΘ away from the photosensitive member is used as a reference direction, namely, 0° (180° is toward inside of the photosensitive member), and the angle formed between the tangent line direction C of the surface of the photosensitive member and the reference line or direction is ΘF, the ΘF is calculated as ARCTAN (FΘ/Fr)

When ΘF/ΘC,

The magnetic force acting on the magnetic brush carrier at the position A is not directed toward the photosensitive member 1.

In order to effect sufficient charging, the nip width where the magnetic brush and the photosensitive member are contacted with each other, measured in the photosensitive member movement direction, is preferably 2–10 mm, and further preferably 3–7 mm. For the sufficient charging, the length between the closest position P and the end position A is preferably 0.5–9 mm and further preferably 2–6 mm.

Using the magnet roller 22 in this embodiment, the magnetic pole position was changed, and the deposition amount of the magnetic brush carrier 23 to the photosensitive member 1 surface was measured. The deposition amount was significantly large when the main magnetic pole $S_1$ is away from the closest position P by not less than 30° in the direction opposite from the sleeve rotation direction (+30°). This is because the resultant force vector F is directed toward the inside of the photosensitive member beyond the tangent line direction C of the photosensitive member surface. The deposition amount is the minimum when the position is at ±20°. Therefore, the magnetic flux density position effective to prevent the deposition of the carrier is accomplished by the position of the main magnetic pole $S_1$ not more than +30° from the closest position P, and preferably by the position about ±20° position of the main magnetic pole $S_1$ from the closest position P.

In this embodiment, the magnetic force acting on the magnetic brush carrier at the position A is controlled by changing the magnetic flux density distribution of the fixed magnet roller 22. It is a possible alternative that the desired direction of the magnetic force is provided by disposing a magnetic member or magnet outside the magnetic brush 24. In this case, the magnetic force adjacent the contact nip D between the magnetic brush 24 and the photosensitive member 1 can be controlled in detail, and therefore, the structure effective to prevent the deposition of the magnetic brush carrier can be provided easily.

As will be understood from the foregoing description, the direction of the resultant force F of the magnetic forces is determinated by the magnitudes of FΘ and Fr and the end position A.

Figure 9:
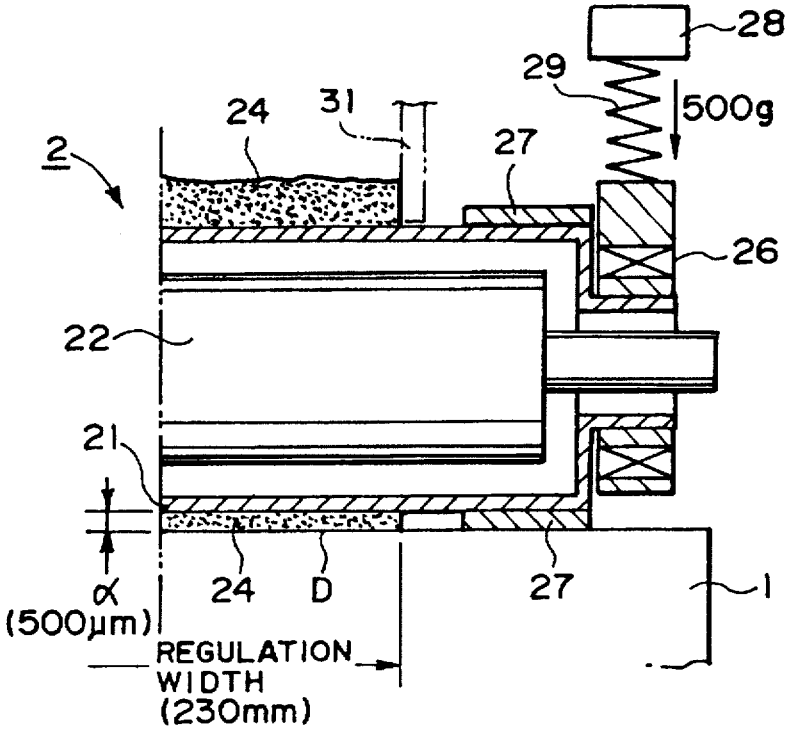
FIG. 9 is a schematic view support structure, at a one end portion side in a longitudinal direction, of the magnetic brush charging member.

Embodiment 2 (FIG. 9)

In this embodiment which is a modification of the first embodiment, the magnetic brush charging member 2 is supported such that the gap between the surface of the charging sleeve 22 as the magnetic brush carrying member and the surface of the photosensitive member 1 at the contact nip D, is constant. The other structures other than the supporting means structure are substantially the same as embodiment 1, and therefore, the detailed description is omitted.

FIG. 9 shows the support structure at a longitudinal end of the magnetic brush charging member 2, and the other side has the same structure.

The charging sleeve 21 of the magnetic brush charging member 2 is rotatably supported by bearings 26 at the opposite ends. The bearing 26 is movable to a certain extent toward and away from the photosensitive member 1 by an unshown maintaining member.

At each of the opposite end portions of the charging sleeve 21, a spacer ring (gap roller) is rotatably provided to limit the gap between the sleeve 21 and the photosensitive member 1 to 500 μm.

The magnet roller 22 as the magnetic field generating means is fixed non-rotatably in the sleeve 21, and the sleeve 21 is rotated at a predetermined peripheral speed by an unshown driving system about the fixed magnet roller 22 coaxially. The carrier 23 is deposited and maintained on the outer peripheral surface of the sleeve 21 as magnetic brush 24 by the magnetic force.

Each of the opposite end portion bearings 26 for the sleeve 21 is urged to the photosensitive member 1 by a coil spring 29 compressed between the spring receiving member 28, so that the spacer ring 27 at the sleeve opposite end portions are normally press-contacted to the surface of the photosensitive member 1 at each end at 500 g at one end, and 1000 g in total. By this, the gap between the charging sleeve 21 and the photosensitive member 1 is normally maintained at 500 μm by the spacer rings 27. The spacer ring 27 is driven by the rotation of the photosensitive member 1.

The magnetic brush 24 on the charging sleeve 21 is limited in the width by the end portion regulating member 31 so that it does not expand outwardly beyond the predetermined width in the longitudinal direction of the sleeve. It is necessary that this magnetic brush regulation width is longer than the image formation width, and in this embodiment, the regulation width is 230 mm.

In this embodiment, between the surface of the photosensitive member 1 as the member to be charged and the surface of the charging sleeve 21 as the magnetic brush carrying member, the spacer member 27 driven by the surface of the photosensitive member 1 is disposed to maintain a constant contact of the spacer member 27 to the surface of the photosensitive member 1 by urging the charging sleeve 21 to the photosensitive member by the urging means 29, by which the gap between the surface of the charging sleeve and the surface f the photosensitive member in the contact nip D of the magnetic brush 24 is always maintained constant even if the photosensitive member 1 is eccentric.

Therefore, the width of the contact nip D between the photosensitive member 1 and the magnetic brush 24 is always constant, so that the occurrence of the charging defect due to the variation of the width can be prevented. In the case of an image forming apparatus, the occurrence of the image defect due to the charging defect can be prevented.

When the photosensitive member 1 and the charging sleeve 21 are fixed separately, the gap between the photosensitive member 1 surface and the charging sleeve 21 is not constant with the result that the magnetic force acting on the portion of the magnetic brush carrier varies at the downstream end position A in the photosensitive member rotation direction at the contact nip D between the photosensitive member 1 and the magnetic brush 24 as described in first embodiment. Therefore, the direction of the magnetic force at the position A may be directed toward inside of the photosensitive member beyond the tangent line of the surface of the photosensitive member, and in this case, the magnetic brush carrier is deposited on the photosensitive member 1.

Using this embodiment, images were produced, and it has been confirmed that good images are produced without the charging non-uniformity or the image defect due to the deposition of the magnetic brush carrier. Therefore, this embodiment is effective to further stabilize the advantages of the first embodiment.

In the foregoing, the magnetic brush is used for the contact charging member of injection charging type, but the magnetic brush charging member of the present invention is usable as a charging member in the contact charging of a type other than the injection charging type.

The present invention is not limited to the process cartridge mounting-and-demounting type or a laser beam printer disclosed as an exemplary apparatus.

While the invention has been described with reference to the structures disclosed herein, it is not confined to the details set forth and this application is intended to cover such modifications or changes as may come within the purposes of the improvements or the scope of the following claims.

What is claimed is:

1. A charging device, comprising:

a charging member for charging a movable member to be charged, said charging member including a carrying member for carrying a magnetic particle layer contactable to the member to be charged, said carrying member being adapted to be supplied with a voltage, wherein a direction of a resultant force of magnetic forces in radial and tangential directions of said carrying member, acting on magnetic particles in the magnetic particle layer at a downstream end position with respect to a movement direction of the member to be charged at a portion where the member to be charged and the magnetic particle layer are contacted, is opposite from the member to be charged with respect to a tangent line of the member to be charged at the end position.

2. A device according to claim 1, wherein said carrying member includes a rotatable sleeve, and said carrying member is provided with a non-rotatable magnet in said rotatable sleeve.

3. A device according to claim 1, further comprising maintaining means for maintaining a constant gap between said carrying member and the member to be charged.

4. A device according to claim 3, wherein said maintaining means includes a spacer member contacted to the member to be charged at a longitudinal end portion of said carrying member.

5. A device according to claim 4, wherein said spacer member is urged toward the member to be charged.

6. A device according to claim 1, wherein a width of contact between the member to be charged and the magnetic particle layer is 2–10 mm, measured in the movement direction of the member to be charged.

7. A device according to claim 6, wherein the width of contact is 3–7 mm.

8. A process cartridge detachably mountable to an image forming apparatus, said process cartridge comprising:

a movable member to be charged, which is capable of carrying an image; and a charging member for charging said member to be charged, said charging member including a carrying member for carrying a magnetic particle layer contactable to said member to be charged, said carrying member being adapted to be supplied with a voltage, wherein a direction of a resultant force of magnetic forces in radial and tangential directions of said carrying member, acting on magnetic particles in the magnetic particle layer at a downstream end position with respect to a movement direction of said member to be charged at a contact portion where said member to be charged and the magnetic particle layer are contacted, is opposite from said member to be charged with respect to a tangent line of said member to be charged at the end position.

9. A process cartridge according to claim 8, wherein said member to be charged is provided with a charge injection layer to which electric charge is injected from said contact portion.

10. A process cartridge according to claim 9, wherein said charge injection layer has a volume resistivity of $1\times10^{10}$–$1\times10^{14}$ Ωcm.

11. A process cartridge according to claim 8, wherein said member to be charged is provided with an electrophotographic photosensitive layer.

12. A process cartridge according to claim 8, wherein a width of contact between said member to be charged and the magnetic particle layer is 2–10 mm.

13. A process cartridge according to claim 12, wherein the width of contact is 3–7 mm.

14. An image forming apparatus, comprising:

a movable member to be charged, which is capable of carrying an image; and a charging member for charging said member to be charged, said charging member including a carrying member for carrying a magnetic particle layer contactable to said member to be charged, said carrying member being adapted to be supplied with a voltage, wherein a direction of a resultant force of magnetic forces in radial and tangential directions of said carrying member, acting on magnetic particles in the magnetic particle layer at a downstream end position with respect to a movement direction of said member to be charged at a portion where said member to be charged and the magnetic particle layer are contacted, is opposite from said member to be charged with respect to a tangent line of said member to be charged at the end position.

15. An apparatus according to claim 14, wherein said member to be charged is provided with a charge injection layer to which electric charge is injected from the contact portion.

16. An apparatus according to claim 15, wherein said charge injection layer has a volume resistivity of $1\times10^{10}$–$1\times10^{14}$ Ωcm.

17. An apparatus according to claim 14, wherein said member to be charged is provided with an electrophotographic photosensitive layer.

18. An apparatus according to claim 14, wherein a width of contact between the member to be charged and the magnetic particle layer is 2–10 mm, measured in the movement direction of said member to be charged.

19. An apparatus according to claim 18, wherein the width of contact is 3–7 mm.

* * * * *

UNITED STATES PATENT AND TRADEMARK OFFICE

CERTIFICATE OF CORRECTION

PATENT NO. : 5,754,927

DATED : May 19, 1998

INVENTOR(S) : HARUMI ISHIYAMA ET AL.

It is certified that error appears in the above-identified patent and that said Letters Patent is hereby corrected as shown below:

COLUMN 1

Line 30, "as as" should read --as--.
Line 51, "a-charging" should read --a charging--.

COLUMN 2

Line 34, "problems. Release" should read --problems: release--.
Line 63, "provide" should read --provide a--.

COLUMN 3

Line 10, "be" should read --to be--.
Line 31, "structure" should read --structural--.

COLUMN 5

Line 30, "one one" should read --one--.

COLUMN 6

Line 23, "injection cite" should read --an injection site--.

COLUMN 9

Line 32, "n" should read --on--.

UNITED STATES PATENT AND TRADEMARK OFFICE

CERTIFICATE OF CORRECTION

PATENT NO. : 5,754,927

DATED : May 19, 1998

INVENTOR(S) : HARUMI ISHIYAMA ET AL.

It is certified that error appears in the above-identified patent and that said Letters Patent is hereby corrected as shown below:

COLUMN 10

Line 64, "The other" should read --The--.

COLUMN 11

Line 45, "f" should read --of--.
Line 61, "in" should read --in the--.
Line 63, "toward" should read --toward the--.

Signed and Sealed this

Second Day of March, 1999

*Attest:*

Q. TODD DICKINSON

*Attesting Officer*

*Acting Commissioner of Patents and Trademarks*